US007077381B2

(12) United States Patent
Wiemken et al.

(10) Patent No.: US 7,077,381 B2
(45) Date of Patent: Jul. 18, 2006

(54) DESENSITIZING ARMATURE AIR GAP TO COMPONENT DISTORTION IN A FUEL INJECTOR

(75) Inventors: Norval J. Wiemken, Dwight, IL (US); Alan R. Stockner, Metamora, IL (US); Scott F. Shafer, Morton, IL (US); Steven Tian, Bloomington, IL (US); Mark S. Cavanagh, Bloomington, IL (US)

(73) Assignee: Caterpillar Inc., Peoria ( * ) Notice: Subject to any disclaimer, the term of this patent is extended or adjusted under 35 U.S.C. 154(b) by 167 days.

(21) Appl. No.: 10/631,163

(22) Filed: Jul. 31, 2003

(65) Prior Publication Data

US 2004/0021016 A1 Feb. 5, 2004

(51) Int. Cl.
*B05B 1/30* (2006.01)

(52) U.S. Cl. ..... 251/129.16; 137/15.18

(58) Field of Classification Search ..... 137/15.01, 137/15.18, 15.21; 251/129.16
See application file for complete search history.

(56) References Cited

U.S. PATENT DOCUMENTS 5,054,691 A * 10/1991 Huang et al. ..... 239/585.3
5,197,428 A * 3/1993 Hornby ..... 123/296
5,348,233 A * 9/1994 Press et al. ..... 239/585.3
5,697,342 A * 12/1997 Anderson et al. ..... 123/446
6,880,766 B1 * 4/2005 Lewis et al. ..... 239/88

* cited by examiner

*Primary Examiner*—J. Casimer Jacyna
(74) *Attorney, Agent, or Firm*—Liell & McNeil

(57) ABSTRACT

Because of the relatively high pressures experienced within fuel injectors, several internal components can undergo substantial deformation each time fuel is pressurized to injection levels. In some instances, such as when a solenoid operated control valve is positioned near a distortion region, the internal distortion can cause a fuel injector to behave with less predictability, and can undermine consistency from one fuel injector to another, since distortion levels and affects therefrom are likely to vary substantially from one injector to another. In order to desensitize fuel injector performance to this internal distortion, a deflection cavity is disposed within the fuel injector between the distortion region and the needle valve of the fuel injector. This strategy finds particular applicability to needle control valves disposed deep within fuel injectors in order to control fluid pressure on a closing hydraulic surface of a direct control needle valve, which opens and closes the nozzle outlets.

22 Claims, 3 Drawing Sheets

DESENSITIZING ARMATURE AIR GAP TO COMPONENT DISTORTION IN A FUEL INJECTOR

TECHNICAL FIELD

The present invention relates generally to desensitizing fuel injector performance to internal component distortion, and more particularly to a solenoid carrier assembly that includes a deflection cavity to desensitize solenoid armature air gap to distortion in the fuel injector component stack.

BACKGROUND

Engineers are constantly seeking ways to improve fuel injector performance in order to accomplish various goals, such as reducing undesirable engine exhaust emissions. One strategy that has been adopted in this regard is the use of a hydraulic direct control needle valve to open and close the nozzle outlets of the fuel injector. In such fuel injectors, a needle control valve is moveable between positions that either expose a closing hydraulic surface on a needle valve member to high pressure or low pressure. While this innovation has greatly improved the ability to electronically control fuel injection characteristics, there remains room for improvement.

One area in need of potential improvement relates to the response time of the direct control needle valve to an electrically actuated needle control valve. Among other things, the response time can be improved if the volume of the needle control chamber, which applies either high or low pressure to the closing hydraulic surface of the needle valve, can be reduced. One strategy for accomplishing this goal is to locate the needle control valve and its associated electrical actuator deep inside the fuel injector in close proximity to the direct control needle valve. Another potential strategy for reducing response time is to reduce the travel distance of the needle control valve member, which acts as a pressure switch in exposing the closing hydraulic surface of the direct control needle valve to either high pressure or low pressure. While these two strategies appear to have promise, their implementation can potentially introduce new problems.

In one class of directly controlled fuel injectors, a solenoid is the chosen type of electrical actuator to control movement of the needle control valve. In order for these relatively small fast moving electrically actuated valves to behave predictably, the armature air gap should be known in order to produce predictable results. In order for the valve to perform in a manner consistent with other valves produced in mass production, the air gap should be uniform among valves in order to insure consistent performance in one fuel injector compared to another. These issues are further complicated by the fact that the armature air gap should be relatively small in order to extract the maximum performance from the interaction between the solenoid coil and stator relative to the armature. Furthermore, because the needle control valve wants to be located in close proximity to the direct control needle valve, it might have to be located under a distortion region within the fuel injector, which relates to the area underneath a plunger within a fuel injector. In other words, each time a plunger reciprocates within a fuel injector, fuel is raised to extremely high injection pressure levels. In turn, these pressure forces cause some measurable amount of distortion within the fuel injector. While these distortions are relatively small in magnitude, they can approach a magnitude that is on the same order as an armature air gap tolerance. Thus, in some situations it is possible for component distortion within a fuel injector to cyclically alter the needle control valve's armature air gap to the point that it briefly distorts the armature air gap out of acceptable geometrical tolerances. As such, the predictability of performance is undermined, and the variability in distortion from one fuel injector to another undermines the ability to mass produce valves that behave consistently between different fuel injectors.

Another potential problem introduced by locating an electrically actuated needle control valve in close proximity to the direct control needle valve relates to packaging considerations. In other words, the act of locating the needle control valve deep within the fuel injector further pressures packaging considerations that insure that all of the various fuel injector performance functions and structure can be packaged in an available envelope of space.

One potential strategy for desensitizing injector performance to geometrical distortions taking place within the fuel injector is to employ a two way valve as the needle control valve instead of a three way valve. In the case of a two way valve such as that shown in Heavy Duty Diesel Engines—The Potential of Injection Rate Shaping for Optimizing Emissions and Fuel Consumption", presented by Messrs. Bernd Mahr, Manfred Dürnholz, Wilhelm Polach, and Hermann Grieshaber, Robert Bosch GmbH, Stuttgart, Germany, at the 21st International Engine Symposium, May 4–5, 2000, Vienna, Austria. The control valve member merely moves into and out of contact with a single seat, rather than moving between two seats as in the case of a three way valve. While such a two way valve strategy can potential assist in desensitizing fuel injector performance to component distortion, it necessarily suffers from other draw backs rendering it less than desirable. For instance, a two way valve strategy inherently results in substantial wastage of high pressure fuel since the fuel injector is controlled by opening its high pressure fuel passage directly to a low pressure drain during injection events. Even when flow restrictions are placed in the control passageways, the amount of fuel spilling leakage can be so substantial as to undermine the overall efficiency of the fuel injection system.

The present invention is directed to one or more of the problems set forth above.

SUMMARY OF THE INVENTION

In one aspect, a solenoid carrier assembly includes a carrier with a top surface separated from a bottom surface by a side surface. A stator assembly is attached to the carrier and includes an exposed bottom surface. A deflection cavity is disposed in the carrier between the top surface of the carrier and the stator assembly.

In another aspect, a fuel injector includes a plurality of stacked components, which include a solenoid carrier assembly positioned between a barrel and a needle valve. The solenoid carrier assembly includes a deflection cavity disposed in the solenoid carrier assembly between its top surface and a stator assembly. The deflection cavity is located underneath a plunger bore disposed in the barrel.

In still another aspect, a method of desensitizing armature air gap to component distortion in a fuel injector includes a step of assembling a stator assembly to a carrier, which has a distortion region. The distortion region is separated from a portion of a top surface of the stator assembly with a deflection cavity. The bottom surface of the carrier and the bottom surface of the stator assembly are made flush.

In another aspect, a carrier assembly includes a stator assembly attached to a carrier. The carrier includes a ball valve seat.

DETAILED DESCRIPTION

Figure 1:
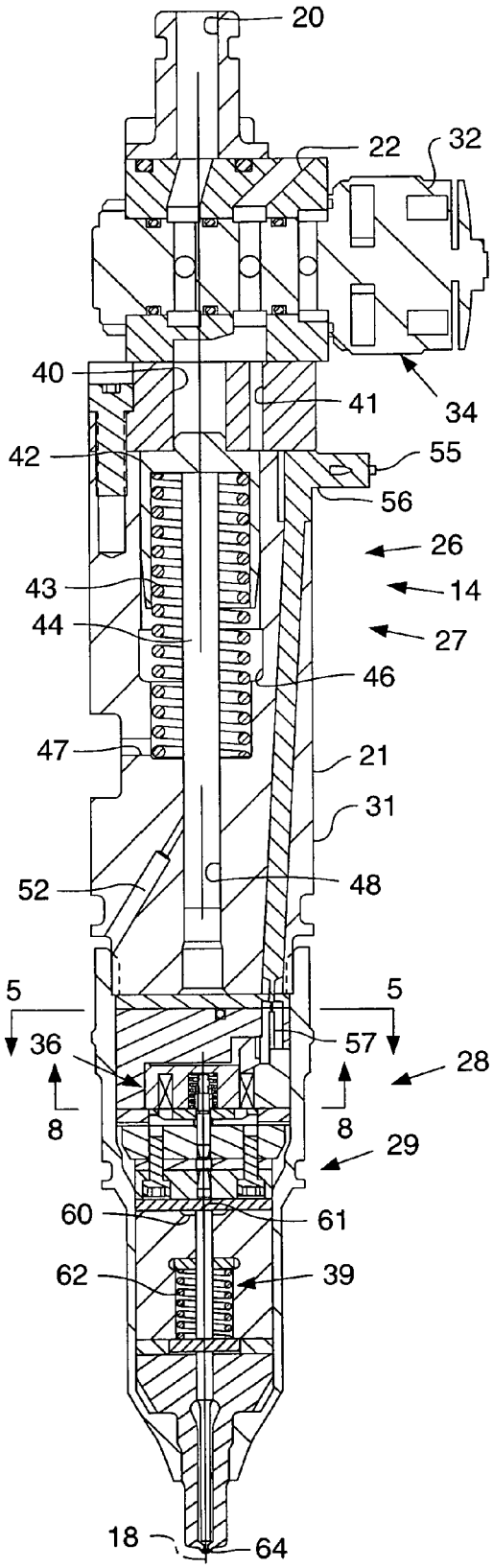
FIG. 1 is a front sectioned diagrammatic view of a fuel injector according to the present invention.
Figure 2:
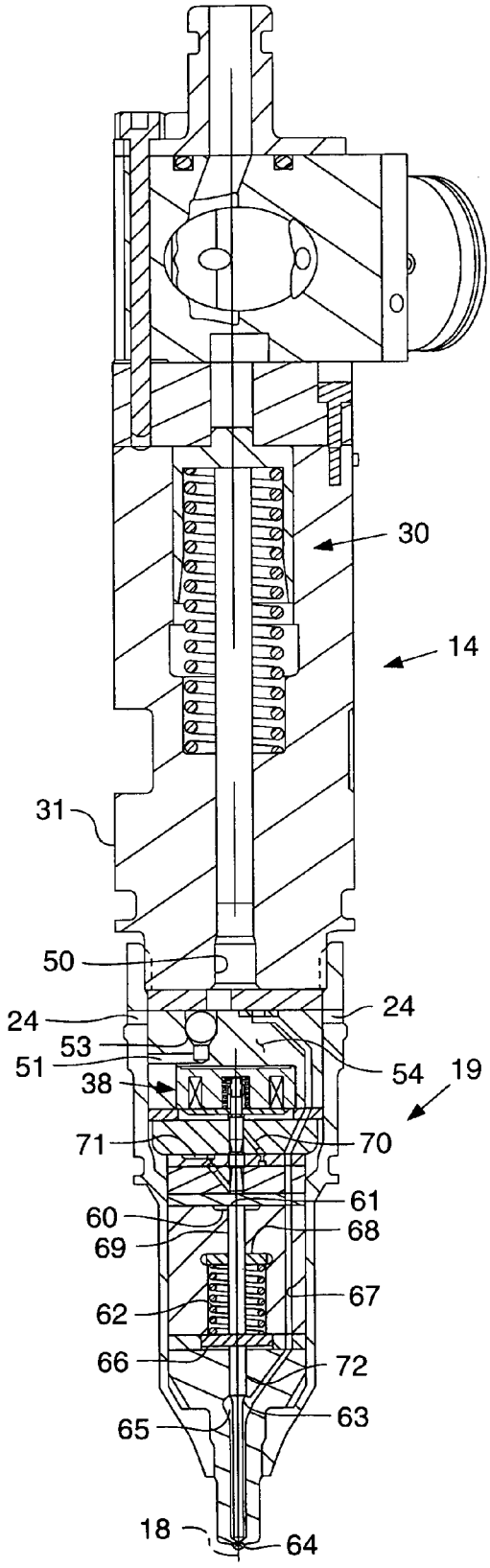
FIG. 2 is a sectioned side diagrammatic view of the fuel injector of FIG. 1.

Referring to FIGS. 1 and 2, a fuel injector 14 includes an injector body 21 that can be thought of as including an upper portion 26 and a lower portion 28. Fuel injector 14 can also be thought of as being divided between fuel pressurization assembly 27 and a direct control nozzle assembly 29. In the fuel injector 14 illustrated, fuel pressurization assembly 27 is located in upper portion 26, whereas direct control nozzle assembly 27 is located in lower portion 28. Although the fuel injector 14 shows the fuel pressurization assembly 27 and the direct control nozzle assembly 29 joined into a unit injector 14, those skilled in the art will appreciate that those respective assemblies could be located in separate bodies connected to one another with appropriate plumbing. The fuel pressurization assembly 27 includes a pressure intensifier 30 and a flow control valve 34, which is operably coupled to an electrical actuator 32. Direct control nozzle assembly 29 includes a needle control valve assembly 36 that is operably coupled to an electrical actuator 38, which is located in and attached to lower portion 28. In addition, a direct control needle valve 39 is controlled in its opening and closing by needle control valve assembly 36, and hence electrical actuator 38. Pressurized oil enters injector body 21 through its top surface at actuation fluid inlet 20, and used low pressure oil is recirculated back to a sump (not shown) via an actuation fluid drain 22. Fuel is circulated among the lower portions 28 of fuel injectors 14 via fuel inlet 24.

Pressure intensifier 30 includes a stepped top intensifier piston 42 and a plunger 44, which is preferably a free floating plunger. Intensifier piston 42 is biased to its retracted position, as shown, by a return spring 43. The stepped top of intensifier piston 42 allows the initial movement rate, and hence possibly the initial injection rate, to be lower than that possible when the stepped top clears its counter bore. Return spring 43 is positioned in a piston return cavity 46, which is vented directly to the area underneath the engine's valve cover via an unobstructed vent passage 47. Piston 42 and plunger 44 move in barrel 31, which is located near the top of the component stack 19. Free floating plunger 44 is biased into contact with the underside of intensifier piston 42 via low pressure fuel acting on one end in fuel pressurization chamber 50. Plunger 44 preferably has a convex end in contact with the underside of intensifier piston 42 to lessen the effects of a possible misalignment. In addition, plunger 44 is preferably symmetrical about three orthogonal axes such that fuel injector 14 can be more easily assembled by inserting either end of plunger 44 into the plunger bore located within injector body 21. When intensifier piston 30 is undergoing its downward pumping stroke, fuel within fuel pressurization chamber 50 is raised to injection pressure levels. Any fuel that migrates up the side of plunger 44 is preferably channeled back for recirculation via a plunger vent annulus and a vent passage 52. Pressure intensifier 30 is driven downward when flow control valve 32 connects actuation fluid passages 40/41 to high pressure actuation fluid inlet 20. Between injection events, flow control valve 34 connects actuation fluid passages 40/41 to low pressure drain 22 allowing the intensifier 30 to retract toward its retracted position, as shown, via the action of return spring 33 and fuel pressure acting on the underside of plunger 44. Thus, when pressure intensifier 30 is retracting, fresh fuel is pushed into fuel pressurization chamber 50 past check valve 53 via fuel inlet 24. Check valve 53 includes carrier 102 having a ball valve seat 113 that is a distance away from top surface 103 that ball valve member 116 is below top surface 103.

A flow control valve 34 includes an electrical actuator 32, which in the illustrated embodiment is a solenoid, but could equally be any other suitable electrical actuator known in the art including, but not limited to, piezos, voice coils, etc. Flow control valve 34 includes a valve body that includes separate passages connected to actuation fluid inlet 20, actuation fluid drain 22 and actuation fluid passages 40/41, respectively. Flow control valve 34 includes a spool valve member biased via a biasing spring to a first position that fluidly connects actuation fluid passage 40/41 to actuation fluid drain 22. When electrical actuator 32 is energized, a spool valve member moves away from the coil toward a second position. At this energized position, the spool valve member closes the fluid connection between actuation fluid passage 40/41 and drain 22, and opens high pressure inlet 20 to actuation fluid passages 40/41.

When pressure intensifier 30 is driven downward, high pressure fuel in fuel pressurization chamber 50 can flow via nozzle supply passage 67 to the nozzle chamber 65, and out of nozzle outlets 64 if direct control needle valve 39 is in an open position. A portion of nozzle supply passage 67 extends between top surface 103 and bottom surface 104 of carrier 102. A reverse flow valve member 117 is positioned in nozzle supply passage 67 adjacent top surface 103, and acts to reduce penetration of combustion gases into fuel pressurization chamber 50. When direct control needle valve 39 is in its closed position as shown, nozzle chamber 65 is blocked from fluid communication with nozzle outlets 64. Direct control needle valve 39 includes a needle valve member made up of a needle portion 72 separated from a piston portion 69 by a lift spacer 66. Thus, the needle valve member in this embodiment is made up of several components for ease of manufacturability and assembly, but could also be manufactured from a single solid piece. The needle valve member includes an opening hydraulic surface 63 exposed to fluid pressure in nozzle chamber 65 and a closing hydraulic surface 61 exposed to fluid pressure in a needle control chamber 60. The thickness of lift spacer 66 preferably determines the maximum opening travel distance of direct control needle valve 39. The direct control needle valve 39 is biased toward its downward closed position, as shown, by a biasing spring 62 that is compressed between lift spacer 66 and a VOP (valve opening pressure) spacer 68. Thus, the valve opening pressure of the direct control valve 39 can be trimmed at time of manufacture by choosing an appropriate thickness for VOP spacer 68.

A needle control chamber 60 is fluidly connected to either low pressure fuel inlet 24 or to nozzle supply passage 67 depending upon the positioning of needle control valve assembly 36. When needle control chamber 60 is fluidly connected to nozzle supply passage 67, direct control needle valve 39 will remain in, or move toward, its closed position, as shown, under the action of fluid pressure forces on closing hydraulic surface 61 and the spring force from biasing spring 62. When needle control chamber 60 is fluidly connected to fuel inlet 24, while nozzle passage 67 and hence nozzle chamber 65 are above a valve opening pressure, the fluid forces acting on opening hydraulic surface 63 are sufficient to lift the direct control needle valve 39 upward towards its open position against the action of biasing spring 62 to open nozzle outlets 64.

Figure 3:
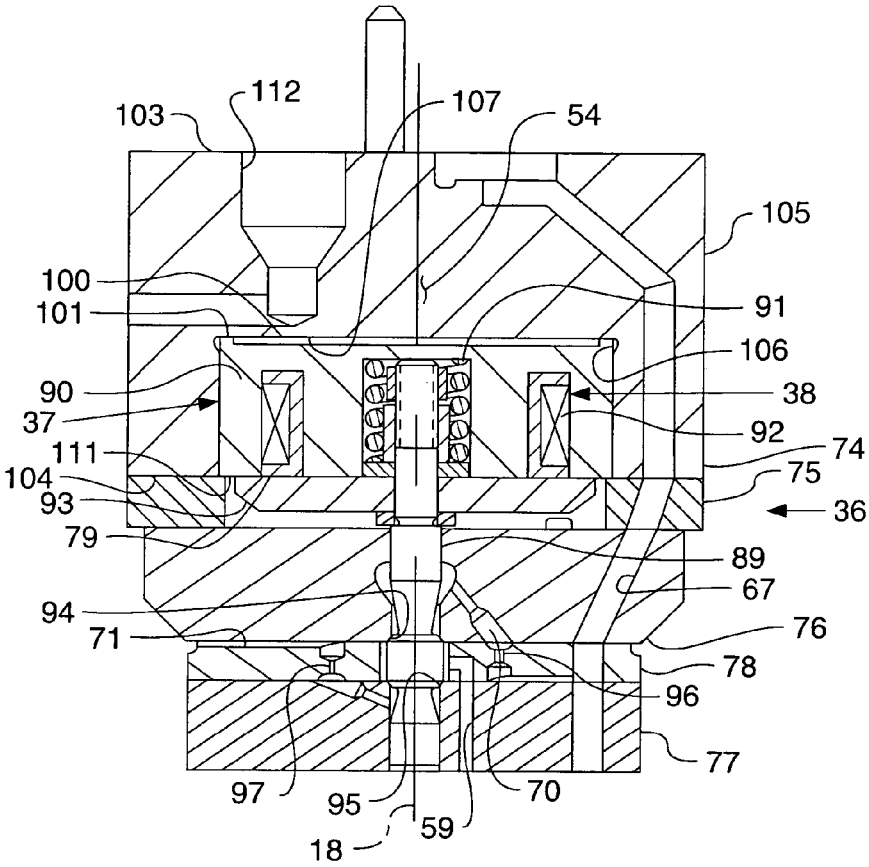
FIG. 3 is a sectioned side view of the needle control valve assembly from the fuel injector of FIGS. 1 and 2.
Figure 4:
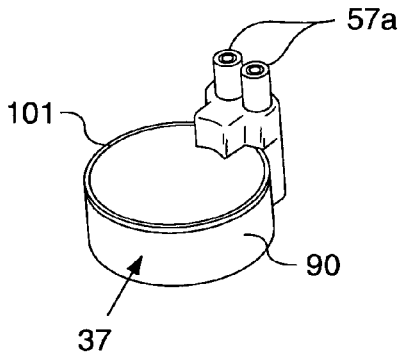
FIG. 4 is an isometric view of a stator assembly according to one aspect of the present invention.
Figure 5:
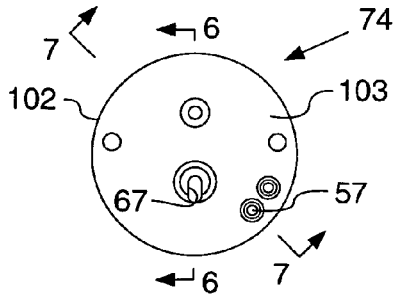
FIG. 5 is a top view of the stator assembly of FIG. 4.
Figure 6:
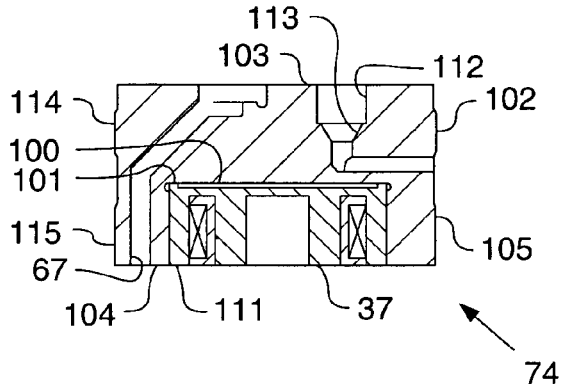
FIG. 6 is a sectioned view of the stator assembly of FIG. 5 as viewed along section line A—A.
Figure 7:
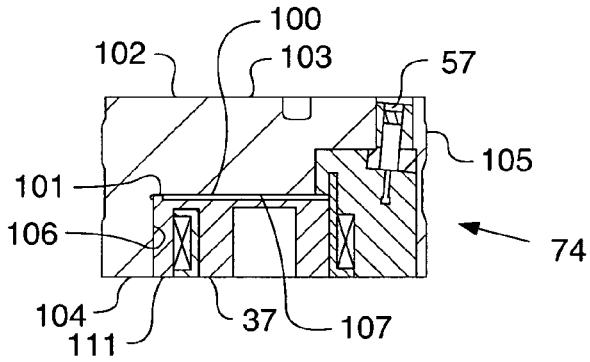
FIG. 7 is a sectioned view of the stator assembly of FIG. 5 as viewed along section line B—B.
Figure 8:
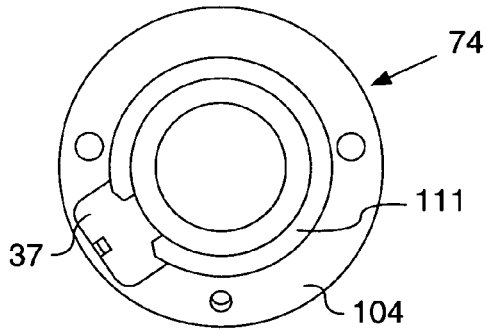
FIG. 8 is a bottom view of the stator assembly of FIGS. 4 and 5.

Referring in addition to FIGS. 3 and 4, the inner workings of needle control valve 36 are illustrated. Valve assembly 36 includes a carrier assembly 74 which defines a portion of nozzle supply passage 67, a connection passage 70, a low pressure passage 71 and a needle control passage 59. The valve assembly 36 is a two position three way valve that includes a needle control valve member 89 that is moveable between contact with a high pressure seat 94 and a low pressure seat 95. Depending upon the position of valve member 89, needle control passage 59, which is fluidly connected to needle control chamber 60 (FIGS. 1 and 2), is fluidly connected to nozzle supply passage 67 via connection passage 70 or to fuel inlet 24 via low pressure passage 71. Needle control valve assembly 36 includes a second electrical actuator 38 which in the illustrated embodiment is a stator assembly 37, but could also be another type of electrical actuator, such as a piezo, a voice coil, etc. The stator assembly 37 includes a stator 90, a coil 92 and a pair of female electrical socket connectors 57 that are electrically connected to coil 92. Stator assembly 37 is attached to carrier 102 to produce a carrier assembly 74. The female electrical socket connection 57, which could instead be male, opens through top surface 103 and permits an electrical extension 56 to mate with stator assembly 37 within injector body 21 while providing exposed terminals for insulated conductors 55 outside of upper portion 26. As illustrated, the socket connection is preferably oriented at a small angle, greater than zero, with respect to centerline 18. Valve member 89 is biased downward to close low pressure seat 95 by a biasing spring 91 via an armature 93 that is attached to valve member 89. When coil 92 is energized, armature 93 is lifted upward causing valve member 89 to open low pressure seat 95 and close high pressure seat 94. Because the flow area is past seats 94 and 95 effect the performance of the fuel injector 14, such as by effecting the opening and/or closing rate of direct control valve 29, flow restrictions 96 and 97 are included. In particular, flow restriction 96, which is preferably manufactured in a valve lift spacer 78 as a flow area that is restrictive relative to the flow area past seat 94. Likewise, flow restriction orifice 97 preferably has a flow area that is restricted relative to the flow past low pressure seat 95. Because these respective orifices 96 and 97 are based upon simple bore diameters rather than a clearance area between two separate moving parts, the performance between respective fuel injectors can be made more uniform. Furthermore, because these features are machined in a single valve lift spacer 78, the manufacturability and assembly of needle control valve assembly 36 can be improved.

Referring in addition to FIGS. 5–8, carrier assembly 74 includes a stator assembly 37 attached to a carrier 102. Stator assembly 37 is preferably attached to carrier 102 by including adhesive along the cylindrical side bore that makes up cavity 106. Stator assembly 37 is preferably advanced into cavity 106 until a peripheral raised portion 101 comes in contact with an internal surface 107 of carrier 102. With this construction, a deflection cavity 100 is created between internal surface 107 and a majority of the top surface of stator assembly 37. This deflection cavity is located directly beneath a deflection region 54 in carrier 102, which itself is located underneath fuel pressurization chamber 50, which forms a portion of the plunger bore (FIG. 2). When fuel is pressurized in fuel pressurization chamber 50, distortion region 54 is highly stressed and deforms in the direction of fuel injector tip along centerline 18. Preferably, the height of raised portion(s) 101 is preferably substantially larger than the expected deformation of region 54. Raised portion 101 is preferably a flat topped ridge arranged in circular pattern. Those skilled in the art will recognize that raised portion 101 could be located on surface 107 of carrier 102. In this way, any distortion in distortion region 54 changes the shape of deflection cavity 100 without causing substantial deformations to occur in stator assembly 37. This in turn prevents the distortion occurring above from substantially altering the air gap 79 that exists between armature 93 and the bottom surface 111 of stator assembly 37.

Other features that help maintain air gap 79 include a desirability in having the bottom surface 111 of stator assembly 37 about flush with the bottom surface 104 of carrier 102. When this feature is combined with an air gap spacer 75 that contacts both bottom surfaces 104 and 111 as shown in FIG. 3, the compressive forces acting on raised portion 101 are transmitted downward along the peripheral portion of stator assembly 37 to the air gap spacer 75, and from there downward in the component stack 19 (FIG. 2).

In order to conserve space and reduce part count, carrier assembly 74 preferably includes other functional features, such as plumbing passages, so that it provides more functionality than merely acting as a support for the stator assembly 37. In particular, carrier 102 includes a top surface 103 separated from a bottom surface 104 by a circumferential side surface 105. Side surface 105 includes a pair of annular ridges 114 and 115, between which fuel supply passage 112 opens. The clearance between ridges 114 and 115 with the inner surface of the casing component shown in FIGS. 1 and 2 provide for an edge filter 51 for fuel entering fuel injector 14 through fuel inlet 24 on its way to fuel pressurization chamber 50. In order to prevent the back flow of fuel through fuel supply passage 112, it includes a check valve 53 that seats in a conical valve seat 113. Apart from this plumbing, carrier assembly 74 includes a portion of nozzle supply passage 67, which extends between top surface 103 and bottom surface 104.

INDUSTRIAL APPLICABILITY

Each engine cycle can be broken into an intake stroke, a compression stroke, a power stroke and an exhaust stroke. During each engine cycle, each fuel injector 14 has the ability to inject up to five or more discrete shots per engine cycle. While a majority of these injection events will take place at or near the transition from the compression to power strokes, injection events can take place at any timing during the engine cycle to produce any desirable effect. For instance, an additional small injection event elsewhere in the engine cycle might be useful in reducing undesirable emissions. During each engine cycle, a number of basic steps are performed to inject fuel, and each of those acts is performed at a timing and in a number to produce a variety of fuel injection sequences, which include one or more injection events.

Among the steps performed at least once each engine cycle in each portion of the injection system (e.g., fuel injector) for each engine cylinder is the step of positioning a needle control valve 36 in a position that fluidly connects the needle control chamber 60 to the fuel pressurization chamber 50, and fluidly blocks the needle control chamber 60 to the low pressure passage 71. In the illustrated embodiment, that is accomplished by biasing the needle control valve member 89 into contact to close low pressure seat 95 by a spring 91. The valve member 89 could be biased in the other direction and operate in a manner opposite to that described with regard to the illustrated embodiment. In the illustrated embodiment, the previously described act is performed by a three way valve. With this configuration, the pressurization chamber 50 is only briefly connected to the fuel inlet 24 when the needle control valve member 89 is moving between low pressure seat 95 and the high pressure seat 94. Between injection events when pressure in fuel pressurization chamber 50 is relatively low, very little leakage occurs past needle control valve assembly 36. In addition, little leakage occurs during each injection event since the respective high pressure seat 94 is closed. When the needle control chamber 60 is fluidly connected to the fuel pressurization chamber 50 and blocked from the low pressure passage 71, no fuel injection takes place. In other words, when that occurs, direct control needle valve 39 is preferably held in or moved toward its downward closed position, as shown.

Another act that is performed at least once during each engine cycle includes increasing fuel pressure within the fuel pressurization chamber at least in part by moving the flow control valve 34 to a first position. The first position described is preferably the position at which valve 34 opens actuation fluid inlet 20 to actuation fluid passage 40/41. When this step is performed, high pressure actuation fluid bears down onto the intensifier piston 42, which compresses fuel in fuel pressurization chamber 50 to injection levels.

Another act that is performed at least once each engine cycle, and in some cases many times per engine cycle, includes moving the needle control valve 36 to a second position that fluidly connects the needle control chamber 60 to the low pressure passage 71, and fluidly blocks the needle control chamber 60 to the fuel pressurization chamber 50. This act is accomplished at least in part by supplying electrical energy to direct control nozzle assembly 29. In the illustrated example, that includes supplying electrical energy to terminals 55 located outside the upper portion of fuel injector 14, and channeling that electricity via electrical socket connection 57 to electrical actuator 32 located in the lower portion 28 of the injector body 21. When this occurs, needle control valve member 89 is lifted to close high pressure seat 94 such that needle control chamber 60 is fluidly connected to low pressure passage 71. If fuel pressure in nozzle chamber 65 is above a valve opening pressure, the direct control needle valve 39 will move to, or stay in, an open position that fluidly connects fuel pressurization chamber 50 to nozzle outlet 64 via nozzle supply passage 67. If fuel pressure is below a valve opening pressure, the direct control needle valve 39 will move toward, or stay in, its biased closed position due to the action of biasing spring 62 being the dominant force.

Another step that occurs at least once each engine cycle includes decreasing fuel pressure in the fuel pressurization chamber 50 at least in part by moving a flow control valve 34 to a position that fluidly connects the actuation fluid passage 40/41 to the actuation fluid drain 22. In the illustrated embodiments, this is the act that allows the fuel injector 14 to reset itself for a subsequent injection sequence. When this step occurs, intensifier piston 42 and plunger 44 will retract upward toward their retracted positions as shown, under the respective actions of return spring 43 and fuel pressure in fuel pressurization chamber 50. In the illustrated embodiment, this act is accomplished by ending electrical energy to actuator 32 in order to allow flow control valve 34 to return to its biased position that opens actuation fluid drain 22.

Referring now to FIG. 3, the needle control valve assembly portion of the component stack 19 is constructed by first trapping valve member 89 between an upper seat component 76 and a lower seat component 77, which are separated by a valve lift spacer 78 having a nominal thickness. Next, the valve travel distance is measured. If its travel distance deviates more than a predetermined amount from a predetermined desired travel distance, a valve lift spacer 78 having a slightly different thickness is chosen in order to cause valve member 89 to have the desired predetermined travel distance. Next, armature 93 is attached to one end of valve member 89. Next, an armature air gap spacer 75 is positioned atop upper seat component 76. A biasing spring 91 is placed on top of armature 93. Finally, a carrier assembly 74 is positioned on top of air gap spacer 75 such that the bottom surfaces 111 and 104 of stator assembly 37 and carrier 102, respectively, are in contact with the top surface of air gap spacer 75. At this point, air gap 79 is measured, if the measured air gap deviates from a predetermined air gap by greater than an acceptable tolerance, an air gap spacer 75 having a different thickness is substituted in place. This substituted air gap spacer should be chosen to have a thickness that results in an air gap 79 having a predetermined magnitude. Thus, when manufacturing a large number of valves, air gap spacer 75 can be provided in a range of thicknesses in order to insure that all of the manufactured valves can be made to have consistently sized air gaps 79.

Carrier assembly 74 is manufactured by first machining the various passageways 67 and 112 therethrough. In addition, cavity 106 is machined in a conventional manner. Next, a stator assembly 37 is preferably glued to the cylindrical surface that defines a portion of cavity 106 until raised portion 101 comes into contact with the undersurface 107 of carrier 102. Some care should be taken to prevent an excessive amount of adhesive from finding its way into deflection cavity 100 during this attachment process. After stator assembly 37 is attached to carrier 102, their bottom surfaces 104 and 111 are ground to be flush with one another and parallel to top surface 103.

During an injection event, the downward movement of pressure intensifier 30 causes fuel pressure in pressurization chamber 50 to rise dramatically. This pressure in turn causes a downward distorting force on carrier assembly 74 in distortion region 54. Preferably, the height of raised portion(s) 101 is preferably larger than the expected deformation of distortion region 54 into deflection cavity 100. In this way, the distortion is not carried through to stator 90 in a way that could substantially alter air gap 79. In the illustrated embodiment, raised portion 101 has a height on the order of about 100 microns, and the expected distortion of distortion region 54 is less than 100 microns across the complete operating range of fuel injector 14.

Those skilled in the art will appreciate that various modifications could be made to the illustrated embodiment without departing from the intended scope of the present invention. Thus, those skilled in the art will appreciate the other aspects, objects and advantages of this invention can be obtained from a study of the drawings, the disclosure and the appended claims.

What is claimed is:

1. A solenoid carrier assembly comprising:

a carrier with a top surface separated from a bottom surface by a side surface;

a stator assembly attached to said carrier and including an exposed bottom surface; and a deflection cavity having a carrier centerline passing therethrough and being disposed in said carrier between said top surface and said stator assembly.

2. The carrier assembly of claim 1 wherein said stator assembly includes at least one of a female electrical socket connector and a male electrical socket connector exposed through said top surface of said carrier for mating to an other of a female electrical socket connector and a male electrical socket connector.

3. A solenoid carrier assembly comprising:

a carrier with a top surface separated from a bottom surface by a side surface;

a stator assembly attached to said carrier and including an exposed bottom surface;

a deflection cavity disposed in said carrier between said top surface and said stator assembly; and said bottom surface of said stator assembly is flush with said bottom surface of said carrier.

4. A solenoid carrier assembly comprising:

a carrier with a top surface separated from a bottom surface by a side surface;

a stator assembly attached to said carrier and including an exposed bottom surface;

a deflection cavity disposed in said carrier between said top surface and said stator assembly; and a first fluid passage disposed in said carrier and extending between said top surface and said bottom surface; and a second fluid passage disposed in said carrier and extending between said top surface and said side surface.

5. The carrier of claim 4 wherein a portion of said second passage is defined by an annular valve seat;

said side surface includes a pair of annular ridges; and said second passage opens through said side surface between said pair of annular ridges.

6. A solenoid carrier assembly comprising:

a carrier with a top surface separated from a bottom surface by a side surface;

a stator assembly attached to said carrier and including an exposed bottom surface;

a deflection cavity disposed in said carrier between said top surface and said stator assembly; and said top surface includes a planar portion oriented parallel to a planar portion of said bottom surface of said carrier.

7. A solenoid carrier assembly comprising:

a carrier with a top surface separated from a bottom surface by a side surface;

a stator assembly attached to said carrier and including an exposed bottom surface;

a deflection cavity disposed in said carrier between said top surface and said stator assembly; and said stator assembly includes a top surface with at least one peripheral raised portion in contact with said carrier; and said deflection cavity being at least partially surrounded by said raised portion.

8. The carrier assembly of claim 7 wherein said raised portion is at least a portion of a circle.

9. A fuel injector comprising:

a solenoid carrier assembly that includes a carrier with a top surface separated from a bottom surface by a side surface, a stator assembly attached to said carrier and including an exposed bottom surface, and a deflection cavity disposed in said carrier between said top surface and said stator assembly a plurality of stacked components, which include said solenoid carrier assembly positioned between a barrel and a needle valve;

said solenoid carrier assembly including a deflection cavity disposed in said solenoid carrier assembly between a top surface and a stator assembly; and said deflection cavity being located underneath a plunger bore disposed in said barrel.

10. The fuel injector of claim 9 including a pressure intensifying pumping element slideably received in said plunger bore.

11. The fuel injector of claim 9 wherein said stator assembly is a portion of a solenoid operably coupled to a control valve, which is located between said solenoid carrier and said needle valve.

12. The fuel injector of claim 11 wherein said needle valve is a direct control needle valve that includes a closing hydraulic surface exposed to fluid pressure in a needle control chamber; and said control valve has a first position in which said needle control chamber is fluidly connected to a low pressure passage; and a second position in which said needle control chamber is blocked to said low pressure passage.

13. The fuel injector of claim 12 wherein said needle control chamber is blocked to a nozzle supply passage when said control valve is in said first position, and fluidly connected to said nozzle supply passage when said control valve is in said second position.

14. The fuel injector of claim 9 wherein said solenoid carrier assembly includes a carrier; and said plurality of stacked components includes an air gap spacer in contact with said carrier and said stator assembly.

15. The fuel injector of claim 9 including a nozzle supply passage disposed in said solenoid carrier assembly and extending between said top surface and a bottom surface; and a fuel supply passage disposed in said solenoid carrier assembly and extending between said top surface and a side surface.

16. The fuel injector of claim 15 wherein a portion of said fuel supply passage is defined by an annular valve seat; and including an edge filter that includes a clearance area between said side surface and a casing component.

17. The fuel injector of claim 9 wherein said stator assembly includes at least one of a female electrical connector and a male electrical connector exposed through said top surface of said solenoid carrier assembly.

18. The fuel injector of claim 17 including an electrical extension with one end exposed adjacent a top of said barrel, a central portion extending through said barrel, and an other end mated to said electrical connector of said stator assembly.

19. The fuel injector of claim 9 wherein said solenoid carrier assembly includes said stator assembly and a carrier;

said stator assembly includes a top surface with at least one peripheral raised portion in contact with said carrier; and said deflection cavity being at least partially surrounded by said raised portion.

20. A method of desensitizing armature air gap to component distortion in a fuel injector that includes solenoid carrier assembly comprising a carrier with a top surface separated from a bottom surface by a side surface, a stator assembly attached to said carrier and including an exposed bottom surface, and a deflection cavity disposed in said carrier between said top surface and said stator assembly, the method comprising the steps of:

assembling the stator assembly to the carrier, which includes a distortion region;

separating the distortion region from a portion of the top surface of the stator assembly with the deflection cavity; and making the bottom surface of the carrier and the bottom surface of the stator assembly flush.

21. The method of claim 20 wherein said separating step includes the steps of:

forming at least one peripheral raised portion on the top surface of the stator assembly; and positioning the raised portion in contact with the carrier.

22. The method of claim 21 including a step of positioning an air gap spacer in contact with said bottom surface of said carrier and said bottom surface of said stator assembly.

* * * * *